US006877470B2

(12) United States Patent
Mitani et al.

(10) Patent No.: US 6,877,470 B2
(45) Date of Patent: Apr. 12, 2005

(54) STARTING CONTROL SYSTEM OF INTERNAL COMBUSTION ENGINE AND STARTING CONTROL METHOD THEREOF

(75) Inventors: Shinichi Mitani, Susono (JP); Toshiaki Asada, Mishima (JP); Yasushi Kusaka, Susono (JP); Kenji Kataoka, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/656,734

(22) Filed: Sep. 8, 2003

(65) Prior Publication Data

US 2004/0060530 A1 Apr. 1, 2004

(30) Foreign Application Priority Data

Sep. 30, 2002 (JP) ..... 2002-285923
May 28, 2003 (JP) ..... 2003-151212

(51) Int. Cl.[7] ..... F02N 11/08
(52) U.S. Cl. ..... 123/179.3; 123/179.5
(58) Field of Search ..... 123/179.3, 179.5

(56) References Cited

U.S. PATENT DOCUMENTS 5,713,320 A * 2/1998 Pfaff et al. ..... 123/179.3
6,588,397 B1 7/2003 Sieber
6,782,860 B2 * 8/2004 Makajima et al. ..... 123/179.3
6,799,547 B2 * 10/2004 Sieber ..... 123/179.5

FOREIGN PATENT DOCUMENTS

| | | |
|---|---|---|
| DE | 199 49 931 A1 | 4/2001 |
| DE | 199 55 857 A1 | 6/2001 |
| JP | A 6-64451 | 3/1994 |
| JP | A 7-71350 | 3/1995 |
| JP | A 2002-130095 | 5/2002 |
| JP | A 2002-147319 | 5/2002 |

* cited by examiner

*Primary Examiner*—Andrew M. Dolinar
(74) *Attorney, Agent, or Firm*—Oliff & Berridge, PLC

(57) ABSTRACT

In a starting control system for an internal combustion engine, an output shaft is rotated in a reverse direction at a predetermined direction upon start of the internal combustion engine, and then is rotated in a normal direction so as to start a cranking operation. The system serves to combust the fuel in a cylinder in an expansion stroke when the output shaft is rotated in the reverse direction, and the resultant combustion pressure is used for performing the cranking operation. This makes it possible to reduce the load exerted to the electric motor.

20 Claims, 13 Drawing Sheets

STARTING CONTROL SYSTEM OF INTERNAL COMBUSTION ENGINE AND STARTING CONTROL METHOD THEREOF

INCORPORATION BY REFERENCE

The disclosure of Japanese Patent Applications No. 2002-285923 filed on Sep. 30, 2002, and No. 2003-151212 filed on May 28, 2003, each including the specification, drawings and abstract are incorporated herein by reference in their entirety.

BACKGROUND OF THE INVENTION

1. Field of Invention

The invention relates to an internal combustion engine for a vehicle, and more particularly, to a technology for controlling start of the internal combustion engine.

2. Description of Related Art

Recently, an electric motor has been generally used for driving (cranking) a crankshaft upon start of the internal combustion engine. The aforementioned electric motor is required to drive the crankshaft against the force generated by compression gas within the cylinder and frictions among the respective elements of the internal combustion engine. As a result, the rating and power consumption of the electric motor is likely to be increased.

Especially the system for automatically stopping the operation of the internal combustion engine upon stop of the vehicle, that is, idling stop system, is required to re-start the internal combustion engine immediately in response to the request of the vehicle operator to re-start. The resultant load exerted to the electric motor is increased, which may lead to increase in both rating and power consumption of the electric motor.

There is a technology proposed for reducing the load exerted to the electric motor by operating the electric motor to rotate the crankshaft in the reverse direction temporarily before cranking starts such that the resultant gas compression force is used for the cranking (see Related Art No. 1, i.e., JP-A-6-64451).

Related Art 2, i.e., JP-A-2002-147319 discloses the technology in which the crankshaft is rotated in the reverse direction when its rotation in the normal direction stops until the moment just before the intake valve of the cylinder positioned just before the top dead center in the compression stroke is opened. This may cause the piston ring to be floated within the piston ring groove such that the pressure within the cylinder is released. The resistance caused by the compression pressure within the cylinder is reduced when the crankshaft is rotated in the normal direction for performing the cranking easily. Alternatively, the piston in a stopped state is set to a position immediately after the top dead center in the compression stroke so as to improve starting ability of the internal combustion engine (see Related Art 3, i.e., JP-A-2002-130095).

In another technology, the fuel is directly injected into a combustion chamber of the cylinder in intake stroke or compression stroke upon start of the internal combustion engine so as to reduce the driving torque required for starting the engine by the combustion torque generated by combusting the fuel, resulting in improved starting ability (see Related Art 4, that is, JP-A-11-159374), for example. The list of Related Art will be described below:

JP-A-6-64451;

JP-A-2002-147319;

JP-A-2002-130095; and

JP-A-11-159874.

In the aforementioned technology as related art, the gas compressive force is likely to be reduced in case of small quantity of residual gas within the cylinder of the internal combustion engine or the low temperature within the cylinder. This may prevent sufficient reduction in the load exerted to the electric motor.

SUMMARY OF THE INVENTION

It is an object of the invention to provide a technology capable of effectively reducing the load exerted to the electric motor driven for starting the internal combustion engine.

A starting control system for an internal combustion engine includes an electric motor that drives an output shaft of the internal combustion engine so as to be rotated, and a controller that controls the electric motor to rotate the output shaft in a first direction, i.e., normal direction subsequent to a rotation of the output shaft in a second direction at a predetermined angle upon start of the internal combustion engine and combusts a fuel in a cylinder in an expansion stroke when the electric motor is rotated in the second direction. The second direction is reverse to the first direction.

A starting control system for an internal combustion engine is structured to start cranking by rotating an output shaft in the reverse direction at a predetermined angle, and then rotating the output shaft in the normal direction so as to start the internal combustion engine. When the output shaft is rotated in the reverse direction, the fuel is combusted within the cylinder in the expansion stroke such that the pressure generated by the combustion is used for cranking. In the case of the internal combustion engine of 4-cycle type where the combustion proceeds in four strokes sequentially within the cylinder in the order of an intake stroke, a compression stroke, an expansion stroke, and an exhaust stroke, the rotating direction of the output shaft by which the compression proceeds in the aforementioned order is referred to as a normal rotating direction. The rotating direction of the output shaft by which the compression proceeds in the reverse order is referred to as a reverse rotating direction. The rotating direction of the electric motor to rotate the output shaft in the normal direction is referred to as a normal rotating direction. The rotating direction of the electric motor to rotate the output shaft in the reverse direction is referred to as a reverse rotating direction.

One of cylinders that is brought into the expansion stroke when the output shaft is rotated in the reverse direction via the electric motor is referred to as the cylinder in the expansion stroke at the reverse rotation of the output shaft. The cylinder in the expansion stroke is identified based on a stop position of the output shaft when the internal combustion engine is stopped.

In the aforementioned starting control system, the electric motor is controlled such that the output shaft is rotated in the reverse direction at the predetermined angle, and then in the normal direction. The predetermined angle is set as the angle of the output shaft to be rotated in the reverse direction such that the residual gas in the cylinder is compressed to increase the temperature therein to become high enough to realize a combustible atmosphere.

The residual gas in the cylinder in the expansion stroke at the reverse rotation of the output shaft is compressed to generate the gas compressive force against the reverse rotation of the output shaft. Further the temperature of the aforementioned cylinder is increased by the compression of the gas, the inside of cylinder is brought into the combustible atmosphere. Then the fuel is injected into the cylinder so as to be combusted therein.

In the above-described case, in addition to the gas compressive force, the pressure generated by combusting the fuel (combustion pressure) serves to rotate the output shaft in the normal direction.

The gas compressive force and the combustion pressure act on the output shaft to be rotated in the normal direction at a timing when the rotating direction is changed from reverse to normal. This makes it possible to reduce the torque of the electric motor for rotating the output shaft in the normal direction.

In the case of the internal combustion engine of compression ignition type, the fuel may be injected into the cylinder in the expansion stroke at the reverse rotation of the output shaft by the fuel injection valve at a timing when the rotating direction of the output shaft is changed from reverse to normal such that the fuel is combusted therein.

It is preferable to control the electric motor to be rotated in the reverse direction until the cylinder reaches the position in the vicinity of top dead center in the expansion stroke, and then to be rotated in the normal direction before the cylinder goes over the top dead center in the expansion stroke.

In the case of the internal combustion engine of spark ignition type, the fuel may be injected into the cylinder in the expansion stroke at the reverse rotation of the output shaft by the fuel injection valve during the reverse rotation of the output shaft, and then the fuel may be ignited by the spark plug upon change in the rotating direction of the output shaft from reverse to normal such that the fuel is combusted in the cylinder.

In an embodiment of the invention, an intake valve and an exhaust valve of a cylinder in an intake stroke when the electric motor is rotated in the second direction are closed such that the fuel is combusted in the cylinder in the intake stroke.

The cylinder in the intake stroke at the reverse rotation of the electric motor is the one of cylinders, which is brought into the intake stroke when the output shaft is rotated in the reverse direction by the electric motor. The cylinder in the intake stroke may be identified based on a stop position (stop angle) of the output shaft when the internal combustion engine is stopped.

The operation to close both the intake valve and the exhaust valve of the cylinder in the intake stroke at the reverse rotation of the electric motor may compress the gas within the cylinder irrespective of the intake stroke. The resultant gas compressive force is generated in the cylinder to resist the reverse rotation of the output shaft. This makes it possible to bring the inside of the cylinder into the combustible atmosphere.

If the fuel is combusted in the cylinder in the intake stroke upon change in the rotating direction of the electric motor from reverse to normal, the gas compressive force and the combustion pressure generated therein may act to rotate the output shaft in the normal direction.

At a timing of change in the rotating direction of the output shaft from reverse to normal, the gas compressive force and the combustion pressure generated in the cylinder in the intake stroke act to rotate the output shaft in the normal direction in addition to the gas compressive force and the combustion pressure generated in the cylinder in the expansion stroke. This may further reduce the torque of the electric motor required for rotating the output shaft in the normal direction.

The quantity of air within the cylinder where the fuel is combusted at a timing just before rotating the output shaft in the reverse direction may give an influence on the condition for combusting the fuel. The combustion pressure generated by combusting the fuel may vary depending on the quantity of air within the cylinder.

In the embodiment of the invention, a crank stop position of the output shaft is changed to a predetermined position so as to increase quantity of air in the cylinder in the expansion stroke while the electric motor being rotating in the second direction within a period from a timing after the internal combustion engine is stopped to a timing when the electric motor starts rotating in the second direction. The crank stop position is determined as the position where the output shaft is stopped when the internal combustion engine is stopped. As the output shaft is designed to rotate, the position is represented by the crank angle.

Upon start of rotating the electric motor in the reverse direction, the quantity of air in the cylinder in the expansion stroke at the reverse rotation of the electric motor where the fuel is combusted becomes larger than that in the cylinder when the internal combustion engine is stopped. The resultant compression of gas in the cylinder at the reverse rotation serves to increase the temperature thereof to become high enough to hold the large quantity of air in the cylinder. The combustion condition of the fuel may be improved, and larger quantity of the fuel may be injected, resulting in higher combustion pressure. As a result, the torque of the electric motor required for rotating the output shaft in the normal direction may further be reduced. The rating of the electric motor, thus, may be reduced.

The crank stop position may be changed before rotating the output shaft in the reverse direction. It is preferable, however, to change the crank stop position immediately after the stop of the internal combustion engine for the smooth response to the request for starting the internal combustion engine.

In the embodiment of the invention, when the crank stop position of the output shaft fails to reach an exhaust valve opening position at which the exhaust valve of the cylinder in the expansion stroke while the electric motor being rotating in the second direction starts opening, the crank stop position is changed to a position just before the exhaust valve opening position.

Assuming that the crank stop position is changed to the position over the one where the exhaust valve of the cylinder in the expansion stroke at the reverse rotation of the electric motor starts opening, if the output shaft is rotated in the reverse direction at the aforementioned position, air within the cylinder may leak from the exhaust valve to the outside owing to inertia. As a result, the quantity of air to be held in the cylinder becomes smaller than that of air to be held when the crank stop position is changed to the one just before the exhaust valve opening position. This indicates a waste of the compressive force generated by the electric motor. Changing the crank stop position to the position just before the exhaust valve of the cylinder opens makes it possible to hold air in the cylinder as much as possible.

The position just before opening of the exhaust valve of the cylinder physically indicates the position of the output shaft at the timing just before the exhaust valve starts opening so as to efficiently hold air in the cylinder as much as possible.

In the starting control system for changing the crank stop position of the output shaft, a fuel combustion condition for combusting the fuel in the cylinder in the expansion stroke while the electric motor being rotating in the second direction is obtained based on at least one of the crank stop position of the output shaft that has been changed and a temperature of the internal combustion engine.

The combustion condition indicates the condition for combusting the fuel in order to obtain the combustion torque from the electric motor that rotates the output shaft in the normal direction for starting the internal combustion engine while reducing the torque output from the electric motor. The aforementioned condition may include the fuel injection quantity or the fuel injection timing. In the case of the internal combustion engine of ignition type, the condition may include the ignition timing and fuel injection timing. In the case of the internal combustion engine of compression ignition type, the condition may include the fuel ignition timing.

It is preferable to combust the fuel in the cylinder in the expansion stroke at the reverse rotation of the output shaft in consideration with the quantity of air (oxygen) or the temperature within the cylinder so as to efficiently generate the combustion torque for assisting the electric motor. Larger quantity of air within the cylinder makes it possible to supply more fuel into the cylinder, and higher temperature makes it possible to promote vaporization of the fuel. As a result, the combustion torque may be generated with less quantity of the fuel. The quantity of air within the cylinder is obtained based on the crank stop position of the output shaft, or the temperature of the cylinder is obtained based on the temperature condition of the internal combustion engine, for example, the cooling water temperature. The fuel is combusted based on at least one of those obtained values. This makes it possible to generate the combustion torque further efficiently.

In the embodiment of the invention, an engine starting torque required for starting the internal combustion engine is obtained, and a combustion torque generated in the cylinder in the expansion stroke while the electric motor being rotating in the second direction is obtained such that the fuel is combusted therein. Further the assist timing at which the electric motor outputs an assist torque to the output shaft is determined based on at least the engine starting torque and the combustion torque such that the assist torque upon rotation of the electric motor in the first direction becomes minimum.

The combustion torque generated by combusting the fuel in the cylinder in the expansion stroke at the reverse rotation of the output shaft for the electric motor varies as the combustion proceeds with time passage from the start of the combustion. The assist torque of the electric motor becomes minimum at a timing when the difference between the engine starting torque and the combustion torque is a minimum value.

If the assist torque is output from the electric motor in the normal rotating direction of the output shaft at the aforementioned timing, the assist torque to be output from the electric motor may start the internal combustion engine while minimizing the assist torque. This makes it possible to further reduce the rating of the electric motor.

The engine starting torque may be calculated based on the temperature condition of the engine, for example, the cooling water temperature and the like. As the cooling water temperature rises, the viscosity of the lubricating oil decreases, and the friction force generated among the sliding portions of the engine is reduced. The combustion torque may be calculated based on the quantity or the ignition timing of the fuel to be combusted in the cylinder in the expansion stroke at the reverse rotation of the output shaft.

The timing at which the assist torque of the electric motor becomes minimum may be obtained based on the engine starting torque, combustion torque, and the like. For example, such timing may be more accurate by considering the torque derived from the compressive counter force of the gas within the cylinder resulting from the rotation of the output shaft.

DETAILED DESCRIPTION OF PREFERRED EMBODIMENTS

Figure 1:
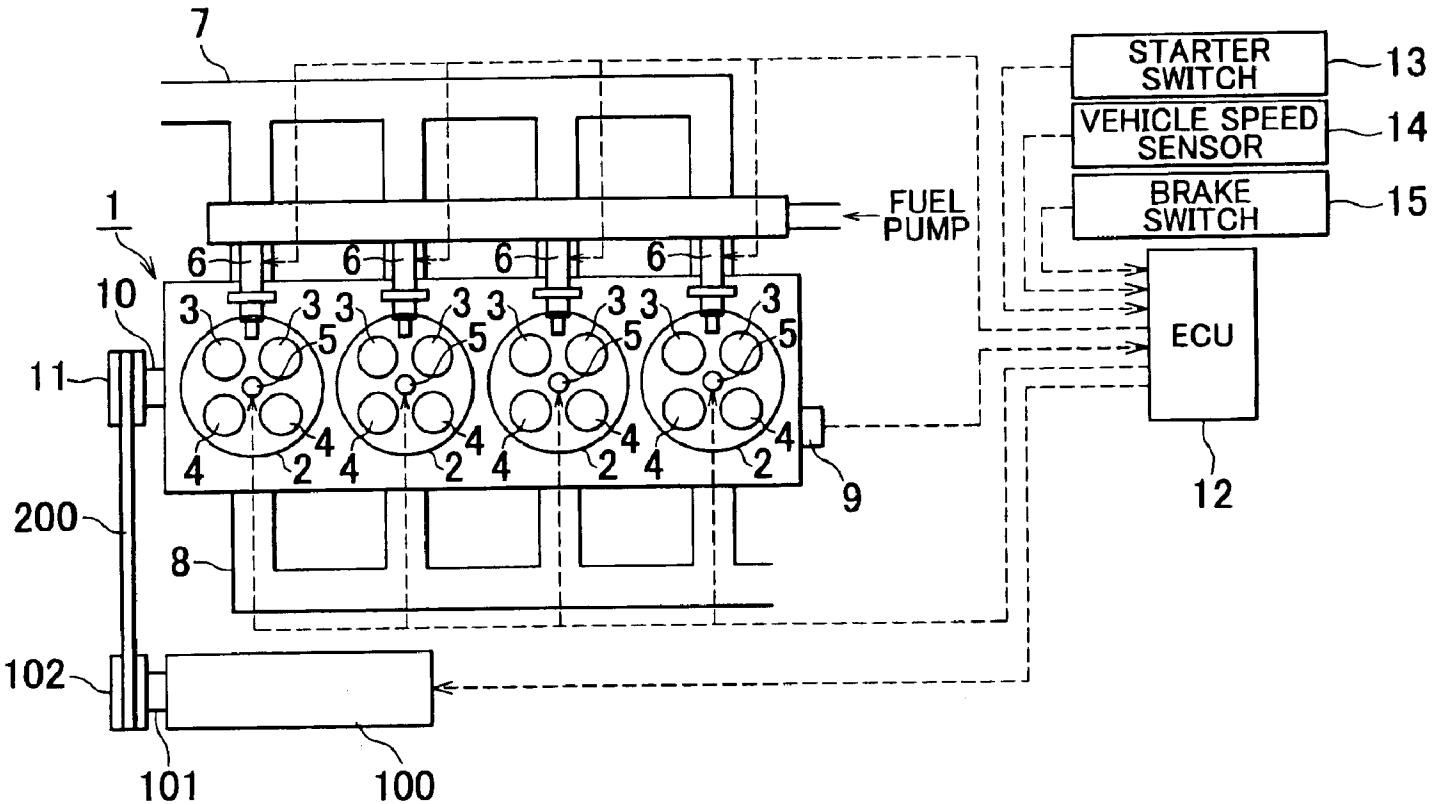
FIG. 1 is a view schematically showing a structure of an internal combustion engine according to a first embodiment.

Preferred embodiments of the start control system of an internal combustion engine of the invention will be described below referring to the drawings.

First Embodiment

A first embodiment of the starting control system of an internal combustion engine according to the invention will be described referring to FIGS. 1 to 4.

FIG. 1 is a view schematically showing a structure of an internal combustion engine to which the invention is applied.

Referring to FIG. 1, an internal combustion engine 1 is a gasoline engine of 4-stroke cycle having in-line 4 cylinders 2.

Each cylinder 2 of the internal combustion engine 1 is provided with an intake valve 3, an exhaust valve 4, a spark plug 5, and a fuel injection valve 6. The internal combustion engine 1 is connected to an intake passage 7 and an exhaust passage 8, respectively. The internal combustion engine 1 is provided with a crank position sensor 9 that outputs a pulse signal at every rotation of an output shaft (crankshaft) 10 of the engine at a predetermined angle of 10°, for example.

The crankshaft 10 is provided with a crank pulley 11 which is connected to a motor pulley 102 attached to a motor shaft 101 via a belt 200 such that power can be transmitted between the crankshaft 10 and the motor shaft 101.

A motor generator 100 is structured to be rotated in the same direction (normal direction) as the rotating direction of the crankshaft 10, and rotated in the direction (reverse direction) reverse to that of the crankshaft 10.

The above-structured internal combustion engine 1 includes an Electronic Control Unit (ECU) 12 for controlling the internal combustion engine 1 and the motor generator 100. The ECU 12 constitutes an arithmetic-logic circuit including CPU, ROM, RAM, back-up RAM and the like The ECU 12 is electrically connected to a starter switch sensor 13, a vehicle speed sensor 14, and a brake switch 15 as well as the crank position sensor 9 so as to receive inputs of signals from those sensors.

The ECU 12 is further electrically connected to the spark plug 5, the fuel injection valve 6, and the motor generator 100 so as to be controlled thereby.

The ECU 12 controls the motor generator 100 to serve as a generator in the state where (1) the internal combustion engine 1 is operated and an electric load of the vehicle is higher than a predetermined value, (2) the internal combustion engine 1 is operated and the power stored in the battery (not shown) falls below a predetermined level, or (3) the internal combustion engine 1 is in a decelerated state.

In this case, the rotating torque of the crankshaft 10 is transmitted to the motor shaft 101 via the crank pulley 11, the belt 200 and the motor pulley 102 such that the motor shaft 101 is driven to rotate. The motor generator 100 generates power that has been converted from the kinetic energy of the motor shaft 101.

The ECU 12 controls the motor generator 100 to serve as a motor upon start of the internal combustion engine 1.

In this case, the motor generator 100 rotates the motor shaft 101, and the resultant rotating torque of the motor shaft 101 is transmitted to the crankshaft 10 via the motor pulley 102, the belt 200, and the crank pulley 11 so as to rotate the crankshaft 10, in other words, start cranking.

When an output signal of the brake switch 15 is turned ON and an output signal of the vehicle speed sensor 14 becomes 0 when the internal combustion engine 1 is operated, that is, the vehicle is stopped in the state where the internal combustion engine 1 is operated, the ECU 12 controls the operation of the spark plug 5 and the fuel injection valve 6 to be temporarily stopped. As a result, the operation of the internal combustion engine 1 is temporarily stopped.

When the output signal of the brake switch 15 changes from ON to OFF, the ECU 12 controls the motor generator 100 to serve as the motor, and the spark plug 5, and operates the fuel injection valve 6 so as to re-start the internal combustion engine 1.

In the case where the start and stop of the internal combustion engine 1 is automatically selected, the internal combustion engine 1 has to be started immediately in response to the change in the output signal of the brake switch 15 from ON to OFF.

The motor generator 100 is required to rotate the crankshaft 10 against the gas compressive force and frictions among elements in the internal combustion engine 1 to be started. The rating and power consumption of the motor generator 100, thus, has to be increased to start the internal combustion engine 1 quickly and reliably.

The starting control system for the internal combustion engine of the embodiment executes the control for starting the internal combustion engine 1 as described below. It is assumed that ignition in the cylinders of the internal combustion engine 1 will be sequentially performed in the order of the cylinders no. 1, no. 3, no. 4, and no. 2. It is also assumed that the rotating angle (hereinafter referred to as a crank angle) of the crankshaft 10 becomes 0° (720°) when the cylinder no. 1 is positioned at the top dead center.

In the starting control system of the embodiment, the ECU 12 drives the motor generator 100 in the reverse direction once, and then drives it in the normal direction. The ECU 12 further controls such that the fuel is combusted in the cylinder 2 in the expansion stroke at the reverse rotation of the motor generator 100 (hereinafter referred to as the cylinder 2 in the expansion stroke at the reverse rotation).

More specifically, the ECU 12 stores the crank angle obtained when the internal combustion engine 1 is stopped, that is, the crankshaft 10 stops rotating (hereinafter referred to as the crank angle obtained at engine stop) in the back-up RAM. The ECU 12 reads the crank angle obtained at engine stop from the back-up RAM upon the next start of the internal combustion engine 1. The cylinder 2 in the expansion stroke at the reverse rotation is identified based on the aforementioned crank angle.

Figure 2:
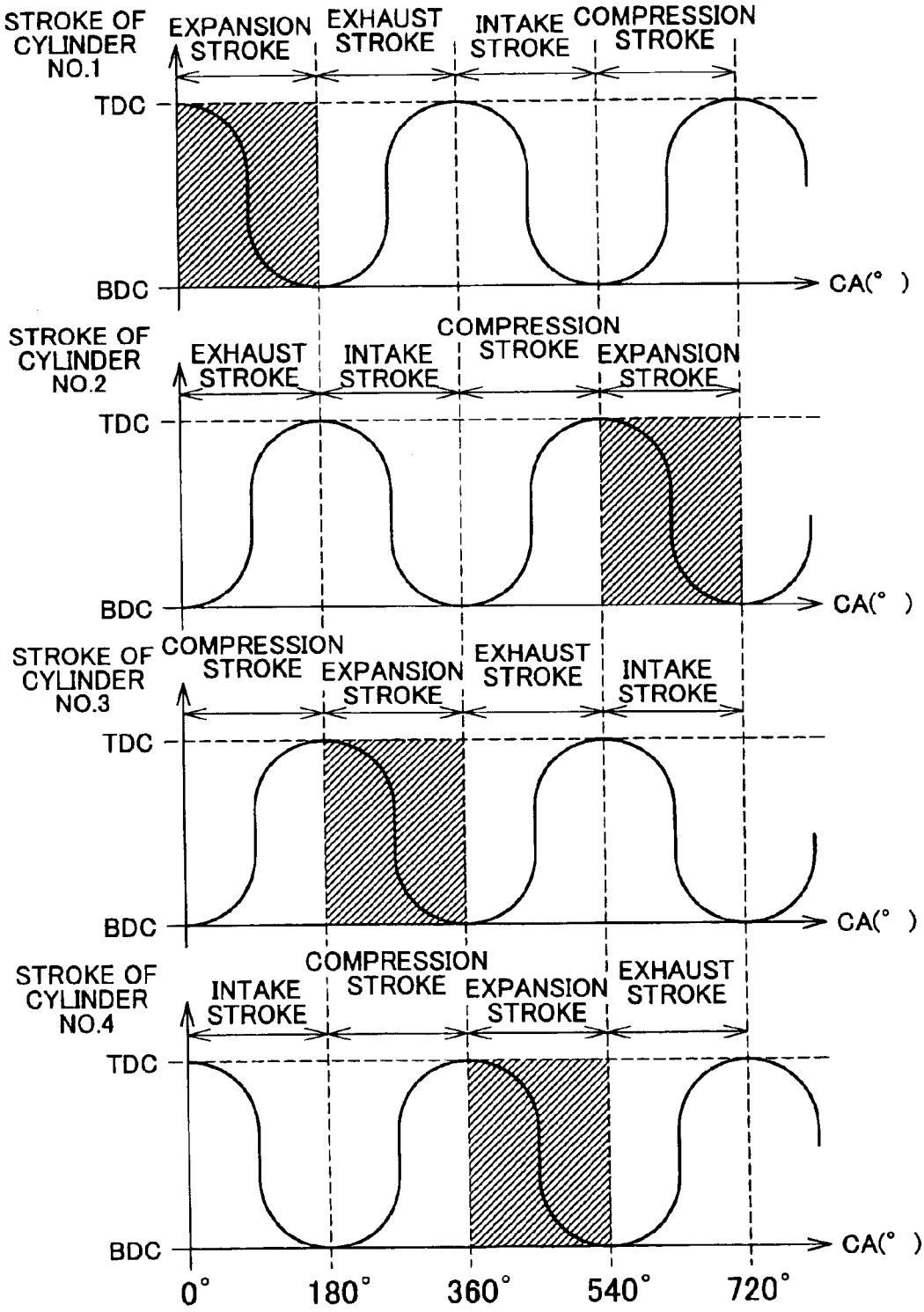
FIG. 2 shows graphs each representing a relationship between the crank angle and the stroke of the respective cylinders.

Referring to FIG. 2, if the crank angle is in the range from 0° to 180°, the cylinder no. 1 is assumed to be in the expansion stroke. If the crank angle is in the range from 180° to 360°, the cylinder no. 3 is assumed to be in the expansion stroke. If the crank angle is in the range from 360° to 540°, the cylinder no. 4 is assumed to be in the expansion stroke. If the crank angle is in the range from 540° to 720°, the cylinder no. 2 is assumed to be in the expansion stroke.

The ECU 12 identifies the cylinder no. 1 as being in the expansion stroke at the reverse rotation if the crank angle obtained at engine stop is in the range from 0° to 180°, the cylinder no. 3 as being in the expansion stroke at the reverse rotation if the crank angle obtained at engine stop is in the range from 180° to 360°. Likewise, the ECU 12 identifies the cylinder no. 4 as being in the expansion stroke at the reverse rotation if the crank angle obtained at engine stop is in the range from 360° to 540°, and the cylinder no. 2 as being in the expansion stroke at the reverse rotation if the crank angle obtained at engine stop is in the range from 540° to 720°.

The ECU 12 controls the motor generator 100 to rotate the crankshaft 10 from the crank angle obtained at engine stop to the position corresponding to the top dead center of the cylinder 2 in the expansion stroke at the reverse rotation (top dead center in the expansion stroke). The ECU 12 further operates the fuel injection valve 6 of the cylinder 2 in the expansion stroke at the reverse rotation.

Figure 3:
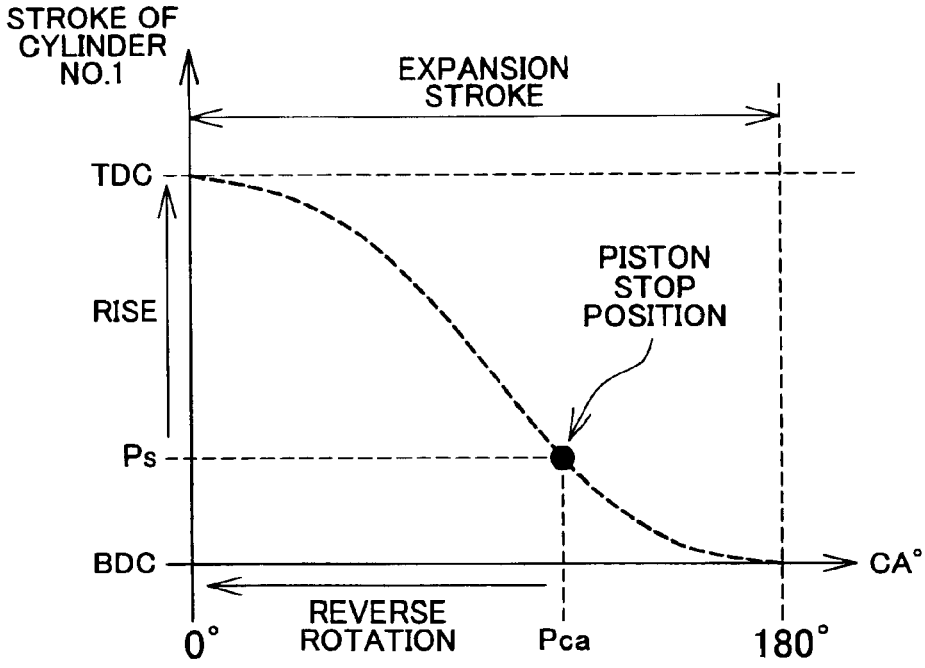
FIG. 3 is a graph representing a relationship between the crank angle and the stroke when the cylinder no. 1 is in the expansion stroke at the reverse rotation of the output shaft.

Referring to FIG. 3, if the cylinder 2 no. 1 is in the expansion stroke at the reverse rotation, the ECU 12 controls the motor generator 100 to rotate the crankshaft 10 in the reverse direction from a crank angle Pca obtained at engine stop to the angle (0°) corresponding to the top dead center of the cylinder 2 no. 1 in the expansion stroke. The ECU 12 then operates the fuel injection valve 6 of the cylinder 2 no. 1.

In this case, the piston (not shown) in the cylinder no. 1 moves up from the stop position (Ps) to the top dead center in the expansion stroke (TDC). The gas in the cylinder no. 1 and the fuel injected from the fuel injection valve 6 are mixed and compressed.

As a result, the gas compressive force against the reverse rotation of the crankshaft 10 is generated in the cylinder no. 1. The gas in the cylinder no. 1 is mixed with the fuel into an air/fuel mixture, and its temperature is increased owing to the compression. The inside of the cylinder no. 1 is brought into a highly combustible atmosphere.

When the crankshaft 10 rotates in the reverse direction from the crank angle Pca obtained at the engine stop to 10° to 20° before the top dead center (the crank angle corresponding to 10° to 20° over the top dead center at the normal rotation of the crankshaft 10), the temperature of the cylinder 2 in the expansion stroke at the reverse rotation is increased to become high enough to allow combustion of the fuel. The ECU 12 controls the motor generator 100 to rotate the crankshaft 10 in the normal direction, and operates the spark plug 5 of the cylinder 2 in the expansion stroke at the reverse rotation.

Then the rotating direction of the crankshaft 10 changes from reverse to normal, and the air/fuel mixture is combusted in the cylinder 2 in the expansion stroke at the reverse rotation.

As a result, the combustion pressure is generated by combustion of the air/fuel mixture in the cylinder 2 in addition to the gas compressive force as described before. The gas compressive force and the combustion pressure act to rotate the crankshaft 10 in the normal direction.

The gas compressive force and the combustion pressure are used for rotating the crankshaft 10 in the normal direction by the motor generator 100. This makes it possible to reduce the torque of the motor generator 100 for performing the cranking operation in the internal combustion engine 1.

The starting control of the embodiment will be described referring to FIG. 4.

Figure 4:
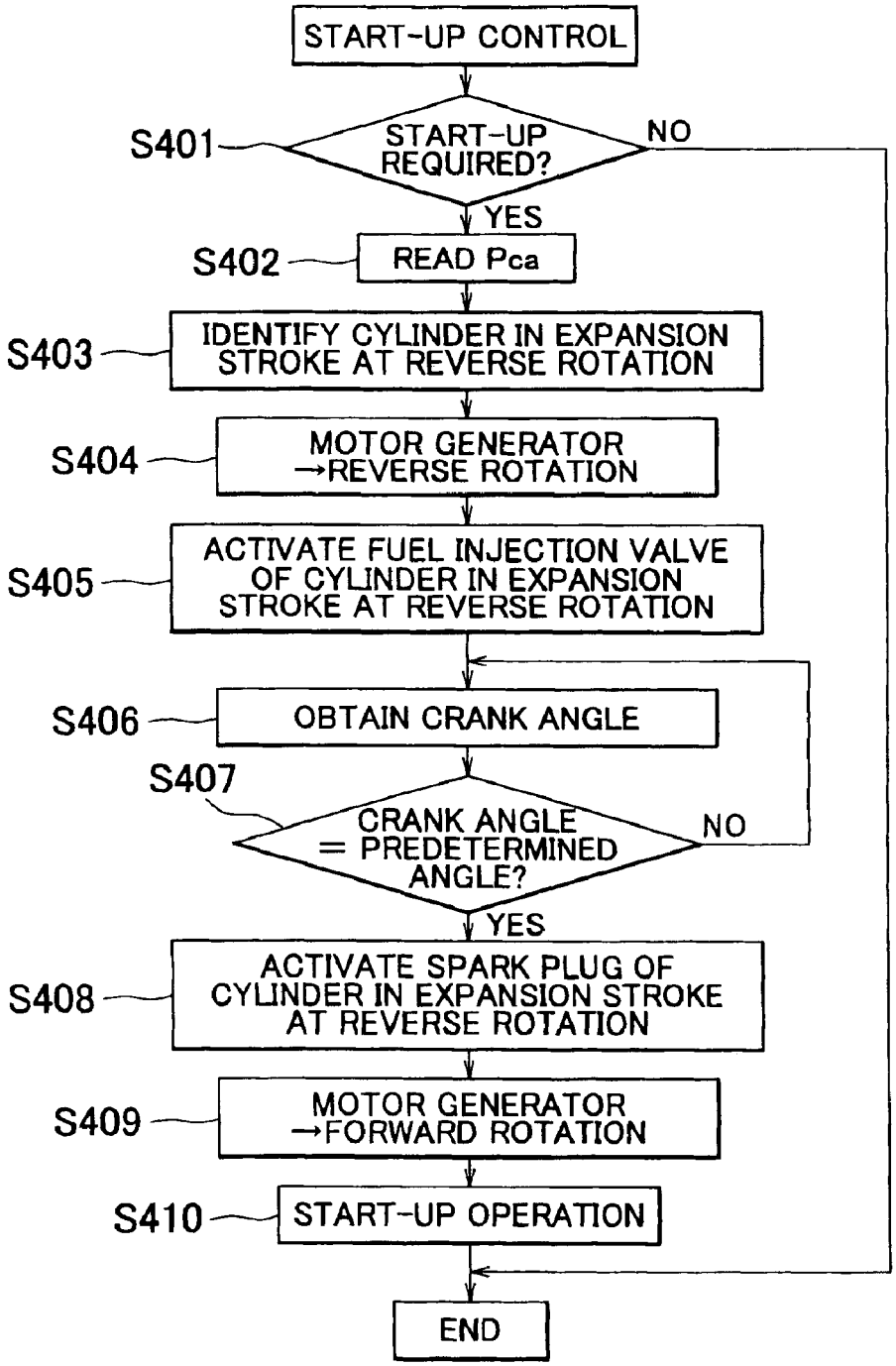
FIG. 4 is a flowchart showing a starting control routine according to the first embodiment.

FIG. 4 is a flowchart showing a starting control routine stored in the ROM of the ECU 12. The routine is executed by the ECU 12 upon start of the internal combustion engine 1.

Referring to the flowchart of the starting control routine, in step S401, it is determined whether a request for starting the internal combustion engine 1 has been issued. If the change in the signal of the starter switch 13 from OFF to ON or in the signal of the brake switch 15 from ON to OFF is detected, it is determined that the request for starting the internal combustion engine 1 has been issued.

If no is obtained in step S401, that is, it is determined the request for starting the internal combustion engine 1 has not been issued, the execution of the routine ends.

If yes is obtained in step S401, that is, it is determined the request for starting the internal combustion engine 1 has been issued, the process proceeds to step S402.

In step S402, the crank angle Pca obtained at engine stop is read from the back-up RAM.

Then in step S403, a cylinder 2 in the expansion stroke at the reverse rotation is identified based on the crank angle Pca. If the crank angle Pca is in the range from 0° to 180°, the cylinder no. 1 is identified as the cylinder in the expansion stroke at the reverse rotation. If the crank angle Pca is in the range from 180° to 360°, the cylinder no. 3 is identified as the cylinder in the expansion stroke at the reverse rotation. If the crank angle Pca is in the range from 360° to 540°, the cylinder no. 4 is identified as the cylinder in the expansion stroke at the reverse rotation. If the crank angle Pca is in the range from 540° to 720°, the cylinder no. 2 is identified as the cylinder in the expansion stroke at the reverse rotation.

In step S404, the motor generator 100 is rotated in the reverse direction so as to rotate the crankshaft 10 in the reverse direction.

In step S405, the ECU 12 controls the fuel injection valve 6 of the cylinder 2 in the expansion stroke at the reverse rotation to be operated.

In step S406, the present crank angle is obtained based on the crank angle Pca obtained ins step S402 and an output signal of the crank position sensor 9. In the case where the crank position sensor 9 is structured to output the pulse signal at every rotation of the crankshaft 10 at a predetermined angle, the ECU 12 multiplies the frequency of generating the pulse signal by the crank position sensor 9 from the start of reverse rotation of the motor generator 100 up to the present with the predetermined angle. The result of the above multiplication is subtracted from the crank angle Pca, resulting in the present crank angle.

In step S407, it is determined whether the crank angle obtained in step S406 has reached the predetermined angle. The predetermined angle, that is, the crank angle represents a position of the cylinder 2 in the expansion stroke at the reverse rotation just before the top dead center. The predetermined angle may be set to 10° to 20° before the top dead center (corresponding to the angle of 10° to 20° over the top dead center when the crankshaft 10 rotates in the normal direction).

If no is obtained in step S407, that is, the crank angle has not reached the predetermined angle, the process returns to step S406.

If yes is obtained in step S407, that is, the crank angle has reached the predetermined angle, the process proceeds to step S408 where the ECU 12 controls the spark plug 5 of the cylinder 2 in the expansion stroke at the reverse rotation so as to be operated.

Then in step S409, the ECU 12 controls the rotating direction of the motor generator 100 from reverse to normal such that the rotating direction of the crankshaft 10 is changed from reverse to normal.

In step S410, the ECU 12 starts a normal engine start operation, that is, operates the spark plug 5 and the fuel injection valve 6.

Execution of the starting control routine by the ECU 12 rotates the crankshaft 10 in the reverse direction once, and then in the normal direction for starting the internal combustion engine 1. As the fuel is combusted in the cylinder 2 in the expansion stroke at the reverse rotation of the crankshaft 10, the gas compressive force and the combustion pressure generated in the cylinder 2 act to rotate the crankshaft 10 in the normal direction.

As a result, the torque required for the motor generator 100 to rotate the crankshaft 10 in the normal direction is reduced. This makes it possible to start the internal combustion engine 1 quickly and reliably without increasing the rating of the motor generator 100.

Second Embodiment

A second embodiment of the starting control system for the internal combustion engine will be described referring to FIGS. 5 to 8. In this embodiment, the different feature from that of the first embodiment is described, and the description of the same feature as that of the first embodiment will be omitted.

In the first embodiment, the fuel is combusted in the cylinder 2 in the expansion stroke when the crankshaft 10 is rotated in the reverse direction. Meanwhile in the second embodiment, the fuel is combusted in the cylinders 2 both in the expansion stroke and in the intake stroke when the crankshaft 10 is rotated in the reverse direction.

Figure 5:
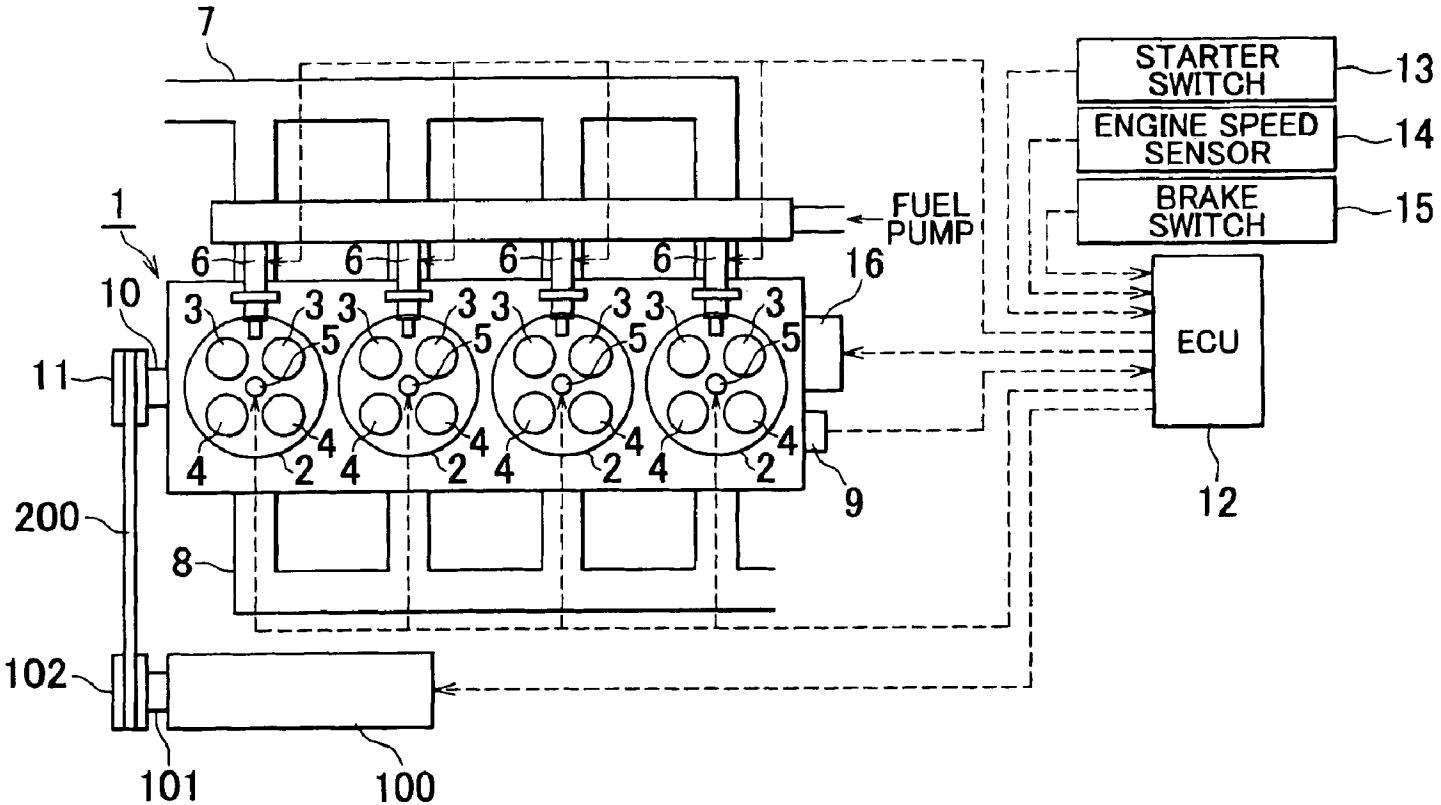
FIG. 5 is a view schematically showing a structure of an internal combustion engine according to a second embodiment.

Referring to FIG. 5, the internal combustion engine 1 is provided with a variable valve train 16 for changing each timing for operating the intake valve 3 and the exhaust valve 4. The variable valve train 16 is electrically connected to the ECU 12 that outputs signals, and controls the operation timing of the intake valve 3 and the exhaust valve 4 based on the output signals.

In a starting control of the embodiment, upon start of the internal combustion engine 1, the cylinders 2 both in the expansion stroke (the cylinder in the expansion stroke at the reverse rotation of the motor generator 100) and in the intake stroke (the cylinder in the intake stroke at the reverse rotation of the motor generator 100) are identified based on the crank angle Pca obtained at engine stop.

Figure 6:
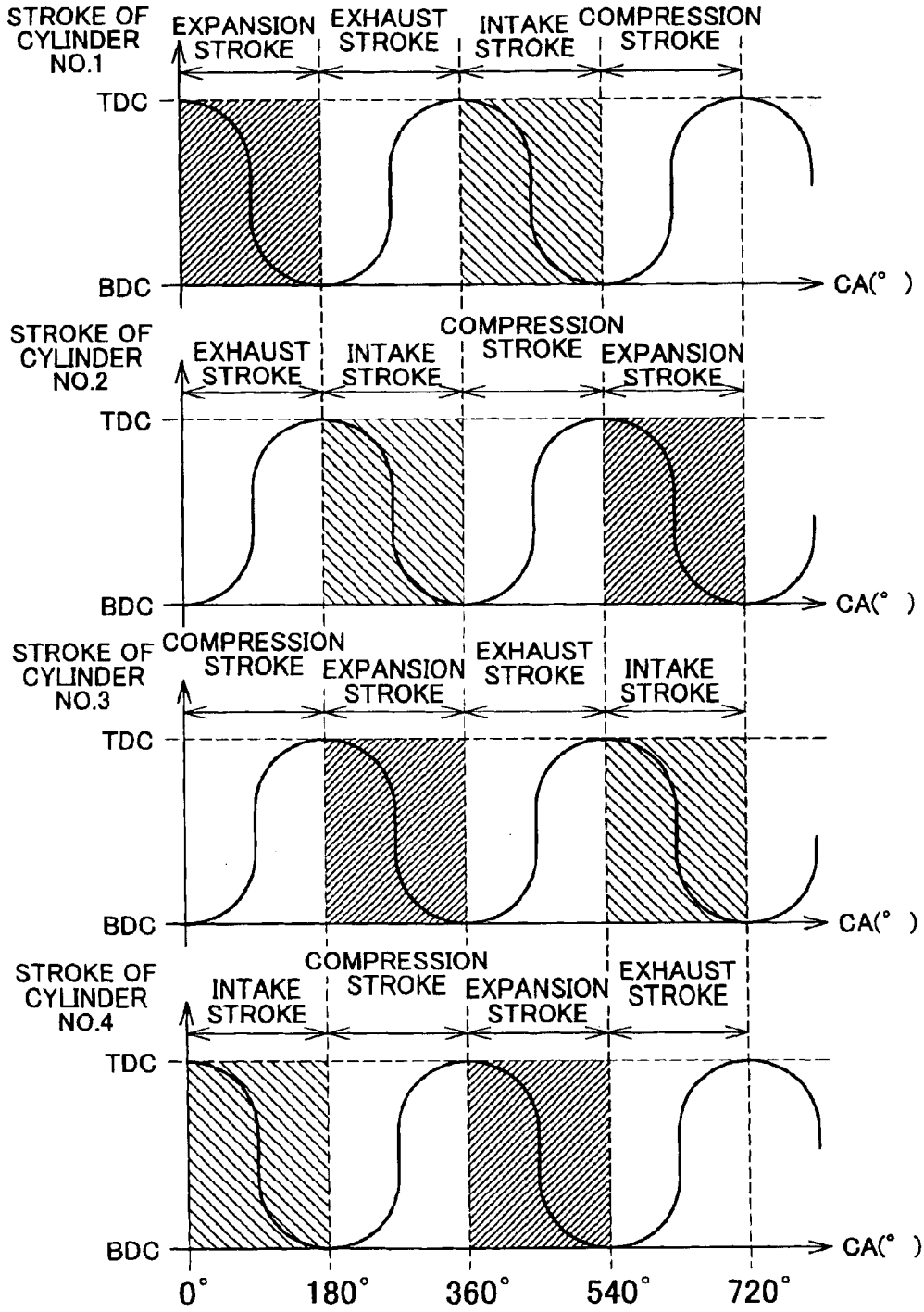
FIG. 6 shows graphs each representing a relationship between the crank angle and the stroke of the respective cylinders.
Figure 7:
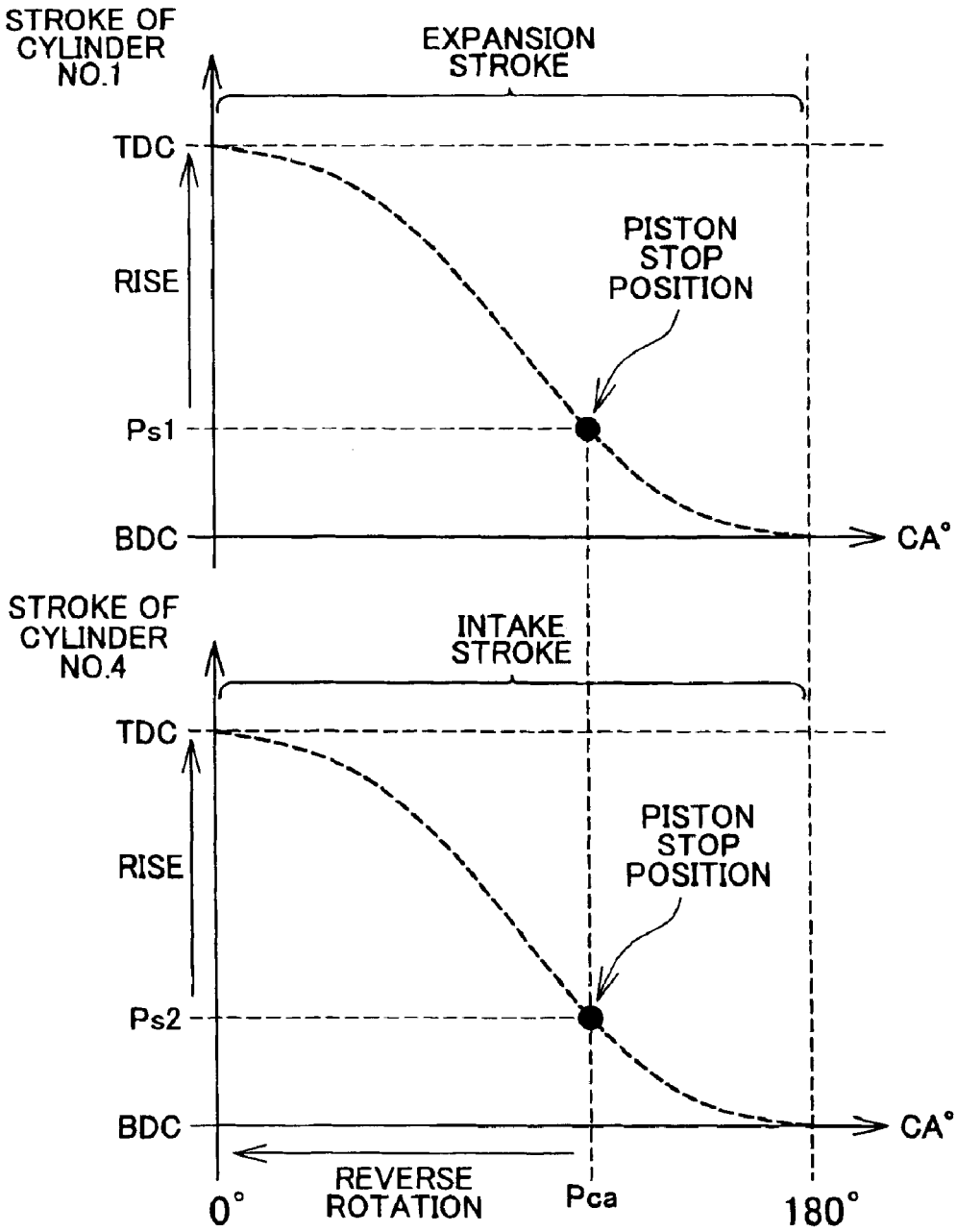
FIG. 7 shows graphs each representing a relationship between the crank angle and the stroke with respect to the cylinders no. 1 in the expansion stroke at the reverse rotation of the output shaft, and the cylinder no. 4 in the intake stroke at the reverse rotation of the output shaft.

Referring to FIG. 6, when the crank angle is in the range from 0° to 180°, the cylinder no. 1 is in the expansion stroke and the cylinder no. 4 is in the intake stroke. When the crank angle is in the range from 180° to 360°, the cylinder no. 3 is in the expansion stroke and the cylinder no. 2 is in the intake stroke. When the crank angle is in the range from 360° to 540°, the cylinder no. 4 is in the expansion stroke and the cylinder no. 1 is in the intake stroke. When the crank angle is in the range from 540° to 720°, the cylinder no. 2 is in the expansion stroke and the cylinder no. 3 is in the intake stroke.

When the crank angle is in the range from 0° to 180°, it is determined that the cylinder no. 1 is in the expansion stroke, and the cylinder no. 4 is in the intake stroke. When the crank angle is in the range from 180° to 360°, it is determined that the cylinder no. 3 is in the expansion stroke, and the cylinder no. 2 is in the intake stroke. When the crank angle is in the range from 360° to 540°, it is determined that the cylinder no. 4 is in the expansion stroke, and the cylinder no. 1 is in the intake stroke. When the crank angle is in the range from 540° to 720°, it is determined that the cylinder no. 2 is in the expansion stroke, and the cylinder no. 3 is in the intake stroke.

The ECU 12 controls the motor generator 100 to rotate the crankshaft 10 in the reverse direction in the range from the crank angle obtained at engine stop to the one representing the top dead center of the cylinder in the expansion stroke at the reverse rotation of the motor generator 100. Alternatively the ECU 12 controls the motor generator 100 to rotate the crankshaft 10 in the reverse direction in the range from the crank angle obtained at engine stop to the one representing the top dead center of the cylinder in the intake stroke at the reverse rotation of the motor generator 100.

In the internal combustion engine 1, the crank angle representing the top dead center of the cylinder 2 in the expansion stroke becomes the same as that representing the top dead center of the cylinder 2 in the intake stroke. Therefore, the top dead center of each of the cylinders in the expansion stroke and in the intake stroke will be referred to as a common top dead center at reverse rotation.

If the cylinder no. 1 is in the expansion stroke at the reverse rotation, and the cylinder no. 4 is in the intake stroke at the reverse rotation, the ECU 12 controls the motor generator 100 to rotate the crankshaft 10 in the reverse direction in the range from the crank angle Pca at engine stop to the crank angle (=0°) representing the common top dead center at reverse rotation.

In this case, the piston (not shown) of the cylinder no. 1 moves upward from the stop position Ps1 upon start of the engine to the top dead center in the expansion stroke (TDC), and the piston (not shown) of the cylinder no. 4 moves upward from the stop position Ps2 upon start of the engine to the top dead center in the intake stroke (TDC).

In the cylinder 2 in the expansion stroke at the reverse rotation, the piston moves upward while the intake valve 3 and the exhaust valve 4 being closed. The gas that resides in the cylinder 2 in the expansion stroke is compressed to generate the gas compressive force. Meanwhile in the cylinder 2 in the intake stroke, the piston moves upward while at least the intake valve 3 being opened. Therefore, the gas that resides in the cylinder 2 in the intake stroke may flow into the intake passage 7 without being compressed.

Figure 8:
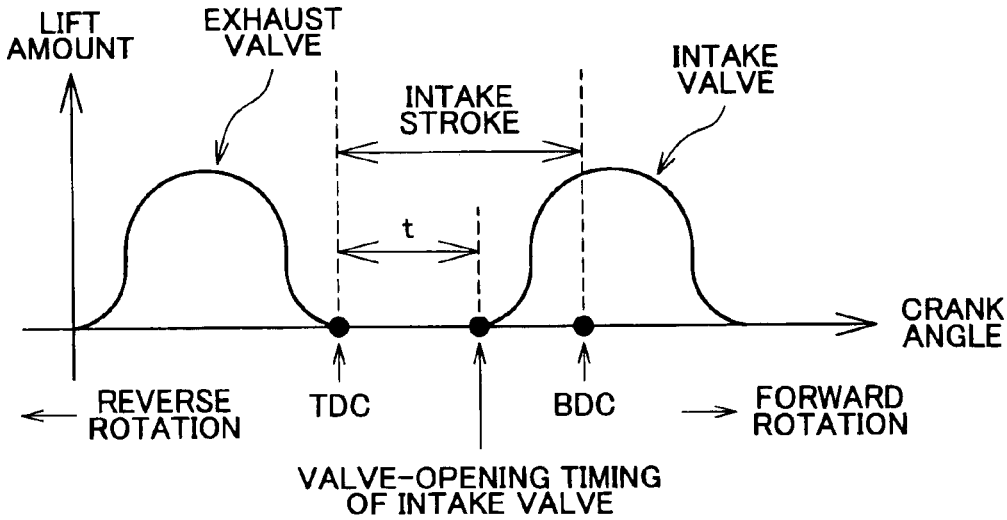
FIG. 8 is a chart representing the operation timing of the intake valve and the exhaust valve for rotating the crankshaft in the reverse direction.

Referring to FIG. 8, the ECU 12 controls the variable valve train 16 to advance the valve closing timing of the exhaust valve 4 before top dead center in the intake stroke (TDC), and to retard the valve opening timing of the intake valve 3 to maximum.

Within the time period t from the top dead center (TDC) in the intake stroke to the valve opening timing of the intake valve 3, the intake valve 3 and the exhaust valve 4 are kept closed. As a result, the gas in the cylinder 2 in the intake valve is compressed within the time period t so as to generate the gas compressive force.

The ECU 12 then operates the fuel injection valves 6 of the cylinders 2 in the expansion stroke and the intake stroke, respectively. It is preferable to operate the fuel injection valve 6 of the cylinder 2 in the intake stroke within the aforementioned time period t.

When the fuel injection valves 6 of the cylinders 2 in the expansion stroke and the intake stroke are operated when the crankshaft 10 is rotated in the reverse direction, the gas and the fuel in those cylinders 2 are compressed to form a highly combustible air/fuel mixture.

When the crankshaft 10 is rotated in the reverse direction from the crank angle Pca to the crank angle just before the common top dead center, for example, 10° to 20° before the common top dead center (corresponding to the crank angle of 10° to 20° over the top dead center when the crankshaft 10 rotates in the normal direction), the temperatures of the cylinders 2 in the expansion stroke and the intake stroke are increased to become high enough to allow combustion of the fuel. Then the ECU 12 controls the motor generator 100 to rotate the crankshaft 10 in the normal direction and operates the spark plugs 5 of the cylinders 2 in the expansion stroke and in the intake stroke.

The rotating direction of the crankshaft 10 is then changed from reverse to normal, and the air/fuel mixture in the cylinders 2 both in the expansion stroke and in the intake stroke is combusted.

As a result, the combustion pressure is generated in the cylinders 2 in the expansion stroke and the intake stroke in addition to the gas compressive force. Both the gas compressive force and the combustion pressure act to rotate the crankshaft 10 in the normal direction.

As the gas compressive force and the combustion pressure act to rotate the crankshaft 10 in the normal direction, the torque of the motor generator 100 required for cranking of the internal combustion engine 1 may be reduced.

The starting control of the embodiment will be described referring to the flowchart of FIG. 9.

Figure 9:
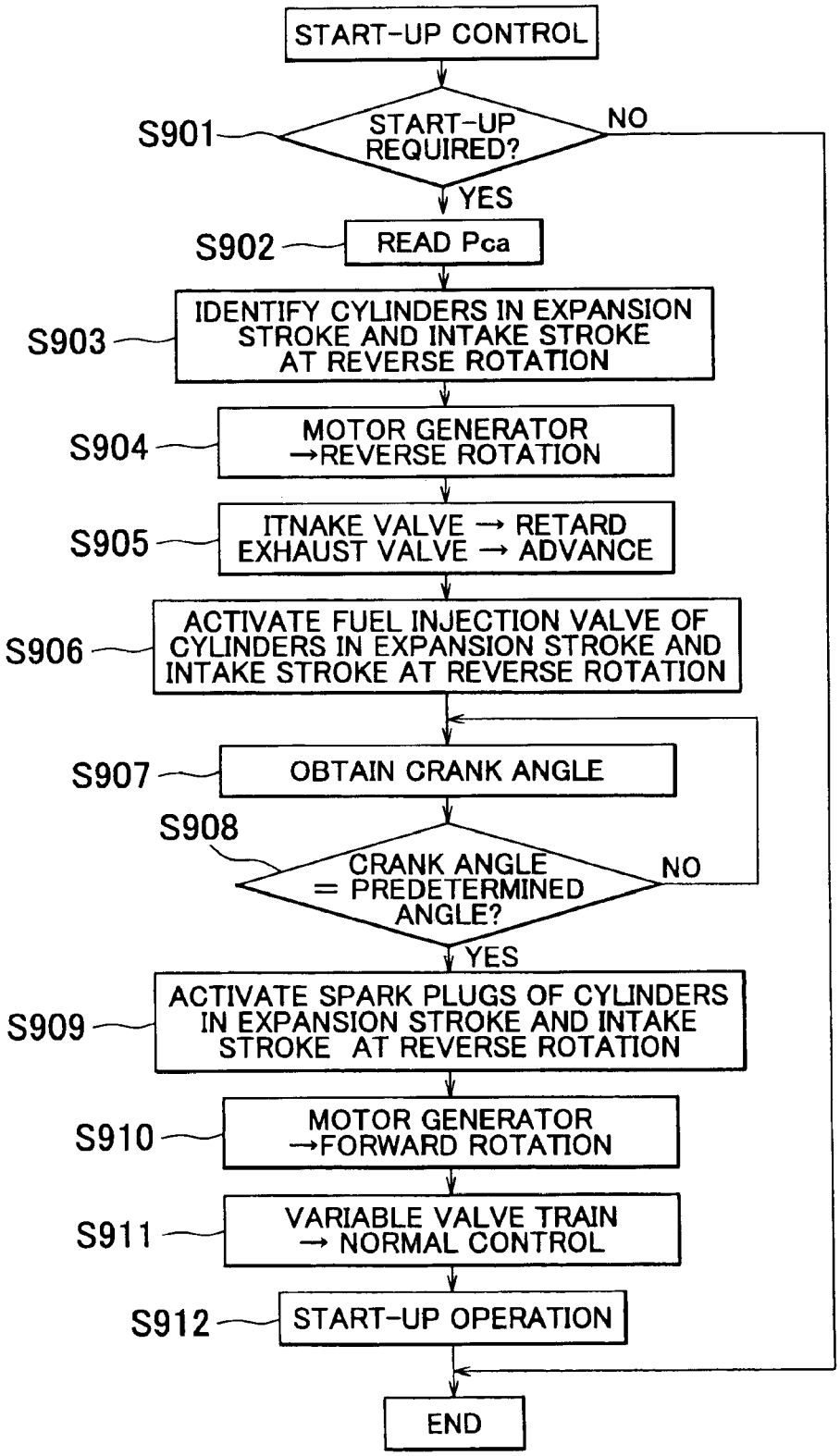
FIG. 9 is a flowchart showing a starting control routine according to a second embodiment.

FIG. 9 is the flowchart of the starting control routine that is preliminarily stored in the ROM of the ECU 12. The ECU 12 executes this routine upon start of the internal combustion engine 1.

First in step S901 of the control routine, it is determined whether a request for starting the internal combustion engine 1 has been received. If no is obtained in step S901, that is, it is determined the request for starting the internal combustion engine 1 has not been received, the ECU 12 ends the control routine.

If yes is obtained in step S901, that is, it is determined the request for starting the internal combustion engine 1 has been received, the process proceeds to step S902.

In step S902, the crank angle Pca obtained at engine stop is read from the back-up RAM.

In step S903, the cylinders 2 in the expansion stroke and in the intake stroke are identified based on the crank angle Pca obtained in step S902.

In step S904, the ECU 12 rotates the crankshaft 10 in the reverse direction by rotating the motor generator 100 in the reverse direction.

In step S905, the ECU 12 controls the variable valve train 16 to advance the valve closing timing of the exhaust valve 4 to the point before top dead center in the intake stroke, and to retard the valve opening timing of the intake valve 3 to maximum.

In step S906, the ECU 12 operates the fuel injection valves 6 of the cylinders 2 in the expansion stroke and in the intake stroke.

In step S907, the present crank angle is obtained based on the crank angle Pca obtained in step S902 and the output signal of the crank position sensor 9.

In step S908, it is determined whether the crank angle obtained in step S907 has reached a predetermined angle. The predetermined angle represents the crank angle just before the common top dead center, for example, 10° to 20° before the common top dead center (corresponding to the angle of 10° to 20° over the common top dead center when the crankshaft 10 rotates in the normal direction).

If no is obtained in step S908, that is, the present crank angle has not reached the predetermined angle, the process returns to step S907.

If yes is obtained in step S908, that is, the present crank angle has reached the predetermined angle, the process proceeds to step S909 where the ECU 12 operates the spark plugs 5 of the cylinders 2 in the expansion stroke and the intake stroke, respectively.

Then in step S910, the ECU 12 changes the rotating direction of the motor generator 100 from reverse to normal so as to change the rotating direction of the crankshaft 10 from reverse to normal.

In step S911, the ECU 12 controls the variable valve train 16 to return the operating timing of the intake valve 3 and the exhaust valve 4 to the normal timing.

In step S912, the ECU 12 starts the normal starting operation.

Execution of the starting control routine rotates the crankshaft 10 in the reverse direction once, and then in the normal direction, and causes the fuel to be combusted in the cylinders 2 in the expansion stroke and in the intake stroke for starting the internal combustion engine 1. The resultant gas compressive force and the combustion pressure generated in those cylinders 2 act to rotate the crankshaft 10 in the normal direction.

As a result, the torque required for the motor generator 100 to rotate the crankshaft 10 in the normal direction is reduced. This makes it possible to start the internal combustion engine 1 quickly and reliably without increasing the rating of the motor generator 100.

In this embodiment, the variable valve train 16 that is capable of changing the operation timing of the intake valve 3 and the exhaust valve 4 is employed for closing the intake valve 3 and the exhaust valve 4 within a period as a part of the intake stroke. In the internal combustion engine 1 provided with the valve train that is capable of suspending the valve-opening operation of the intake valve 3 and the exhaust valve 4, the intake valve 3 and the exhaust valve 4 may be closed within the whole period of the intake stroke.

Third Embodiment

A third embodiment of the starting control system for an internal combustion engine will be described referring to FIGS. 10 to 14. In this embodiment, the other type of the starting control process for the internal combustion engine, and the starting control system shown in FIG. 1 will be described. The description of the structure of those apparatuses, thus, will be omitted.

Figure 10A:
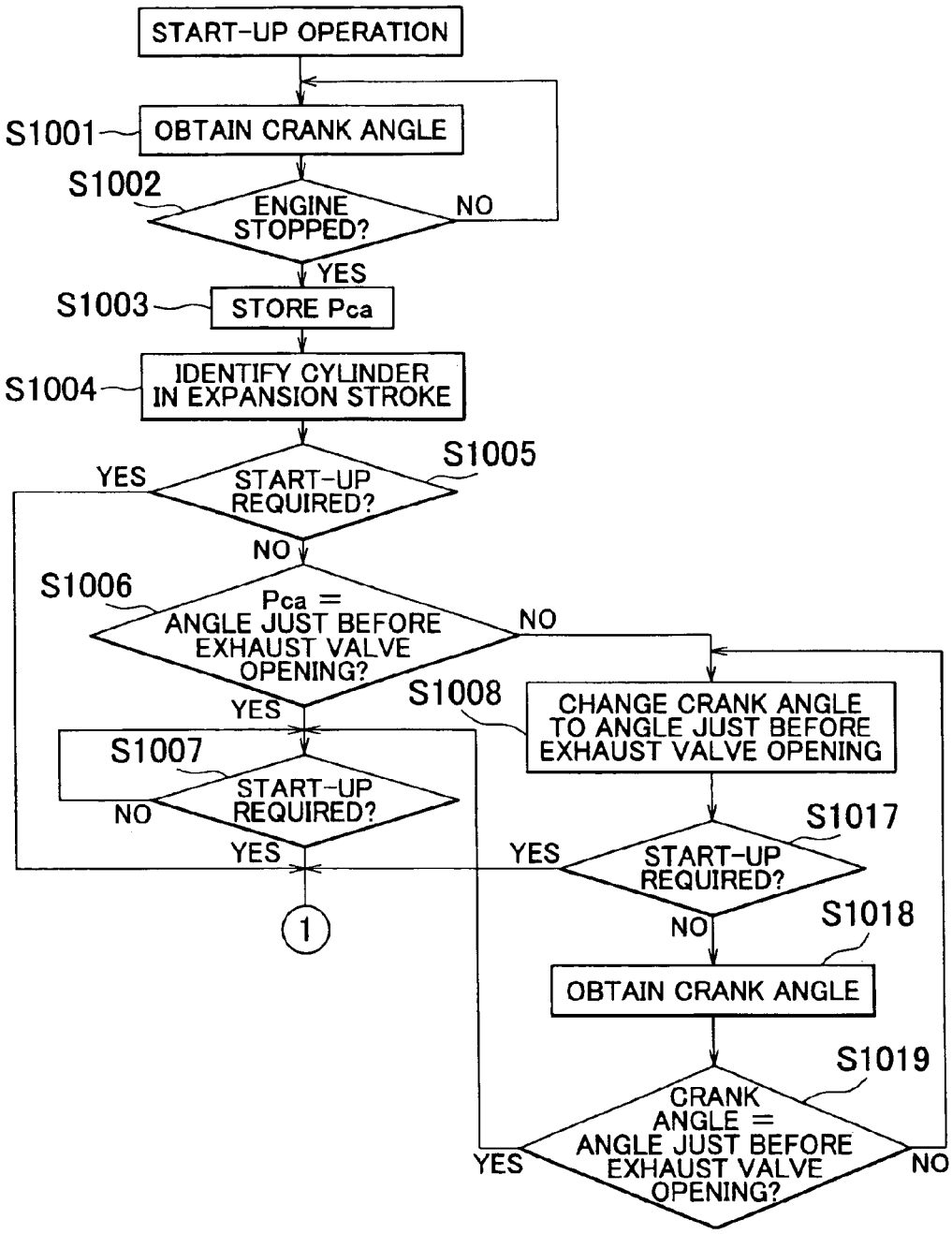
FIG. 10 is a flowchart showing a starting control routine according to a third embodiment.
Figure 10B:
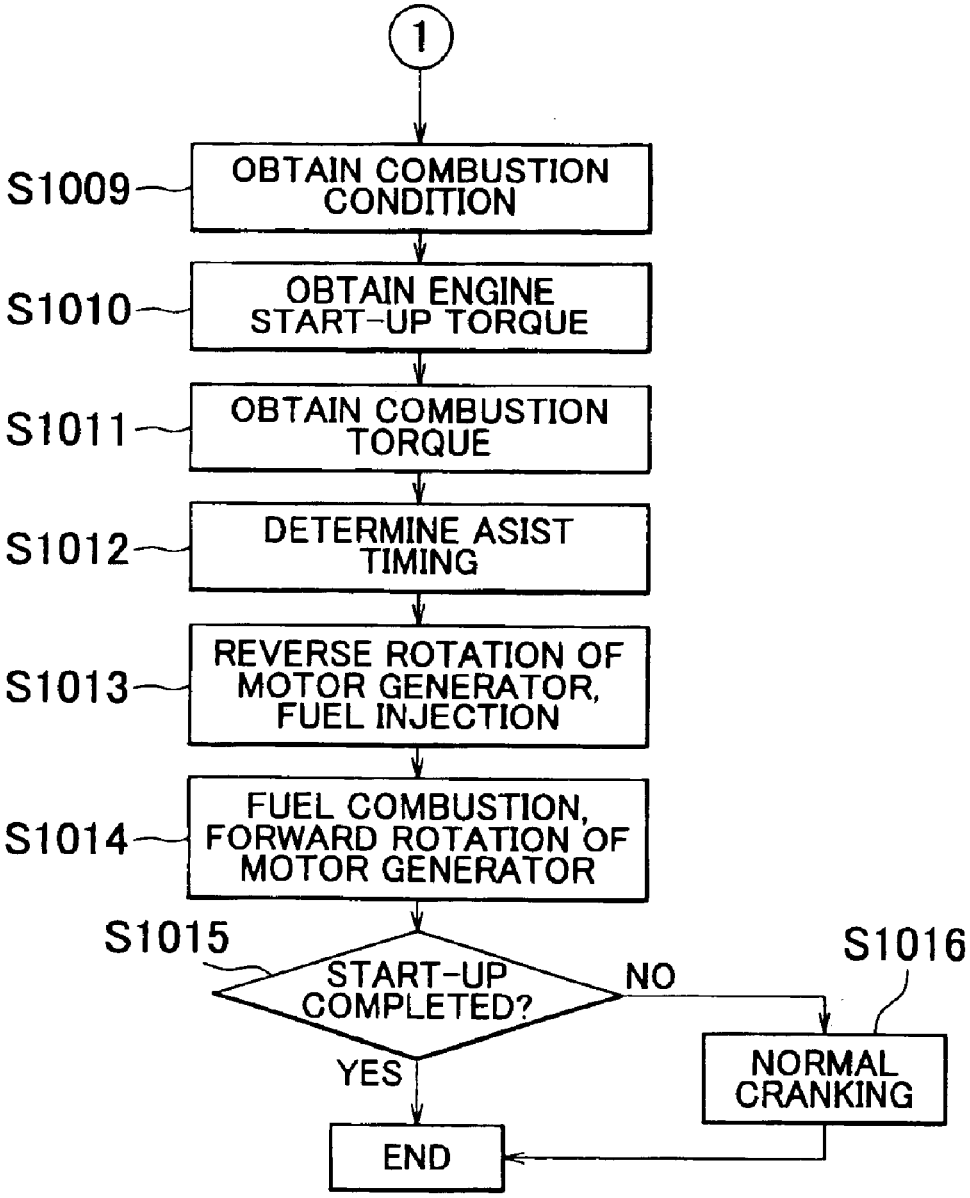

FIG. 10 is a flowchart of a starting control routine for the internal combustion engine 1 executed by the ECU 12. First in step S1001, the ECU 12 obtains a crank angle of the crankshaft based on the detection signal of the crank position sensor 9. Then process proceeds to step S1002.

In step S1002, it is determined whether the internal combustion engine 1 is stopped based on the operation states of the spark plug 5 and the fuel injection valve 6 which are expected to be temporarily stopped upon stop of the vehicle having the internal combustion engine 1 mounted thereon. If Yes is obtained in step S1002, that is, it is determined that the internal combustion engine 1 is stopped, the process proceeds to step S1003. Meanwhile if No is obtained in step S1002, that is, it is determined that the internal combustion engine 1 is not stopped, the process returns to step S1002.

In step S1003, the crank angle Pca corresponding to a crank stop position of the crankshaft 10 when the internal combustion engine 1 is brought into a stopped state is detected based on the crank position sensor 9. The detected crank angle Pca is stored in the back-up RAM of the ECU 12. The process then proceeds to step S1004.

In step S1004, the cylinder in the expansion stroke is identified based on the crank angle Pca stored in step S1003. This process is the same as that executed in step S403 of the flowchart shown in FIG. 4 where the cylinder in the expansion stroke at the reverse rotation of the motor generator is identified. The process proceeds to step S1005.

In step S1005, it is determined whether a request for starting the internal combustion engine 1 has been received. The receipt of such request is determined when the starter switch 13 is selected from OFF to ON, or the brake switch 15 is switched from ON to OFF. If Yes is obtained in step S1005, that is, it is determined that the request for starting the internal combustion engine 1 has been received, the process proceeds to step S1009 for responding the request immediately. Meanwhile if No is obtained in step S1005, that is, the request has not been received, the process proceeds to step S1006.

In step S1006, it is determined whether the crank angle Pca stored in step S1003 is equal to an angle just before valve opening timing of the exhaust valve. The angle just before valve opening timing of the exhaust valve is represented by the crank angle of the crankshaft 10 at a time when the exhaust valve 4 of the cylinder identified as being in the expansion stroke in step S1004 starts opening. Assuming that the exhaust valve 4 of the cylinder no. 1 identified as being in the expansion stroke starts opening at the crank angle of 170°, if the obtained Pca is 169° just before the crank angle of 170°, it is determined that the crank angle Pca is equal to the angle just before valve opening timing of the exhaust valve. If Yes is obtained in step S1006, the process proceeds to step S1007. Meanwhile if No is obtained in step S1006, the process proceeds to step S1008.

In step S1007, it is determined whether a request for starting the internal combustion engine 1 has been received.

This routine is repeatedly executed until the receipt of the request for starting the internal combustion engine 1. If Yes is obtained in step S1007, that is, it is determined the request for starting the internal combustion engine 1 has been received, the process proceeds to step S1009.

In step S1008, the ECU 12 drives the motor generator 100 to rotate the crank shaft 10 such that the crank angle becomes equal to the angle just before valve opening timing of the exhaust valve, and the process proceeds to step S1017.

In step S1017, it is determined whether the request for starting the internal combustion engine 1 has been issued likewise in step S1005. If Yes is obtained in step S1017, that is, it is determined the request for starting the internal combustion engine 1 has been received, the process proceeds to step S1009 for responding the request immediately. The internal combustion engine 1 will be immediately started in response to the request for starting even in the process of changing the crank angle to the angle just before opening timing of the exhaust valve. If No is obtained in step S1017, that is, it is determined the request for starting the internal combustion engine 1 has not been received, the process proceeds to step In step S1018, the ECU 12 detects the crank angle of the crankshaft 10 in the process of changing the crank angle to the angle just before valve opening timing of the exhaust valve based on the detection signal of the crank position sensor 9. The process then proceeds to step S1019.

In step S1019, it is determined whether the crank angle obtained in step S1018 is equal to the angle just before valve opening timing of the exhaust valve. If Yes is obtained in step S1019, the process proceeds to step S1007 where it is determined whether the request for starting the internal combustion engine 1 has been received. If No is obtained in step S1019, the process returns to step S1018 for continuing the change in the crank angle to the angle just before valve opening timing of the exhaust valve.

In step S1009, a combustion condition for starting the internal combustion engine 1 in the cylinder 2 identified as being in the expansion stroke is obtained. The condition, for example, the quantity of the fuel injected from the fuel injection valve 6 or the fuel ignition timing through the spark plug 5, may be obtained based on the crank angle of the crankshaft 10 at a timing when the routine in step S1009 is executed or the cooling water temperature (cooling water temperature of the internal combustion engine 1) output from the cooling water temperature sensor (not shown).

Figure 11:
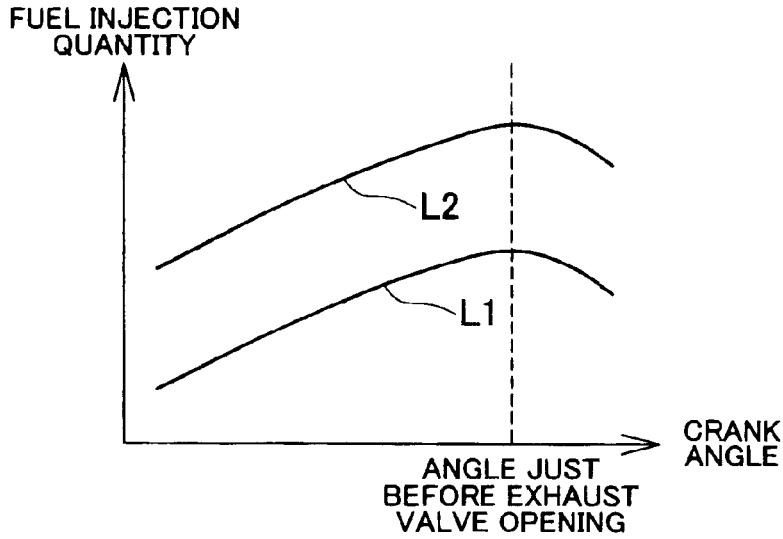
FIG. 11 is a graph showing a change in the fuel injection quantity with respect to the crank angle of the crankshaft.
Figure 12:
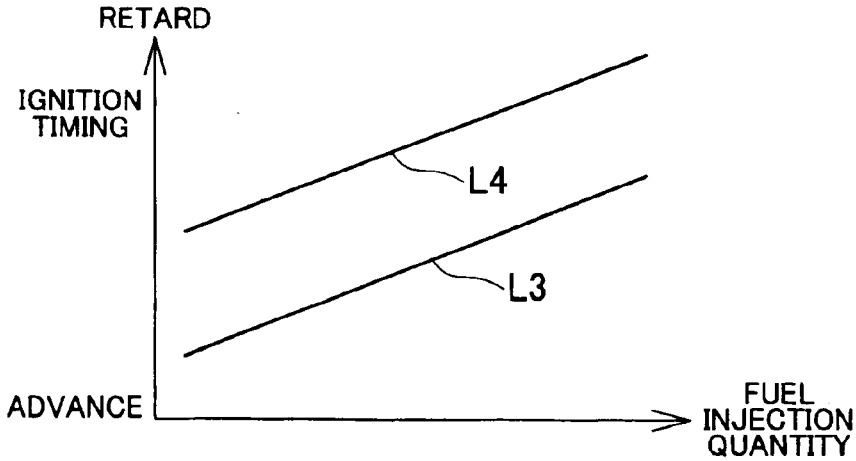
FIG. 12 is a graph showing a change in the ignition timing with respect to the fuel injection amount.

The calculation of the quantity of injected fuel and the ignition timing will be described referring to FIGS. 11 and 12. FIG. 11 shows a graph representing the change in the quantity of the injected fuel with respect to the crank angle of the crankshaft 10. The x-axis of this graph indicates the crank angle, and the y-axis of the graph indicates the quantity of the injected fuel. Each of curves L1 and L2 of the graph shows the change in the quantity of the fuel injection. As shown in FIG. 11, the larger the crank angle becomes, the larger the quantity of air in the cylinder in the expansion stroke becomes. The quantity of the injected fuel, thus, is increased. This makes it possible to generate more combustion torque.

The curves L1 and L2 shows changes in the quantity of the injected fuel when the cooling water temperature of the internal combustion engine 1 is relatively high and relatively low, respectively. The quantity of the injected fuel varies depending on the cooling water temperature of the internal combustion engine 1 because the vaporization of the injected fuel is promoted as the cooling water temperature becomes higher so as to allow the smaller quantity of the fuel to generate more combustion torque.

As the crank angle approaches the angle just before valve opening timing of the exhaust valve, and the cooling water temperature of the internal combustion engine 1 becomes higher, the quantity of the injected fuel becomes large. The torque generated by combustion of the fuel is increased, allowing the load of the motor generator 100 to be reduced. If the crank angle goes over the angle just before valve opening timing of the exhaust valve, air leaks out of the cylinder through the opened exhaust valve 4 owing to inertia upon compression of the gas within the cylinder at the reverse rotation of the crankshaft 10. The resultant quantity of air that can be held in the cylinder becomes comparatively smaller than that of air held in the cylinder when the crank angle has reached the angle just before valve opening timing of the exhaust valve. The crank angle takes a peak value when it is equal to the angle just before valve opening timing of the exhaust valve, and falls as the crank angle is further increased.

If it is determined the request for starting the internal combustion engine 1 has been received in step S1005 or in step S1007, it can be assumed that the crank angle has not reached the angle just before valve opening position of the exhaust valve. The resultant quantity of the injected fuel is reduced compared with that of the injected fuel in the case where the crank angle has reached the angle just before valve opening timing of the exhaust valve.

The calculation of the ignition timing of the fuel will be described. FIG. 12 is a graph showing the change in the ignition timing with respect to the quantity of the injected fuel. The x-axis of the graph represents the obtained quantity of the injected fuel, and the y-axis represents the ignition timing. The lines L3 and L4 represent changes in the ignition timings, respectively. As shown in FIG. 12, the larger the quantity of the injected fuel becomes, the higher the density of the air/fuel mixture in the cylinder identified as being in the expansion stroke becomes. As the time period for the fuel combustion becomes short, the ignition timing is retarded such that the fuel is combusted at more appropriate timing.

The lines L3 and L4 shows changes in the quantity of the injected fuel in the case where the cooling water temperature of the internal combustion engine 1 is relatively low and relatively high, respectively. The quantity of the injected fuel varies depending on the cooling water temperature of the internal combustion engine 1 because the vaporization of the injected fuel is promoted as the cooling water temperature becomes higher, and the combustibility of the fuel is improved to shorten the time period for the fuel combustion.

The ROM of the ECU 12 stores the data including the quantity of the injected fuel with respect to the crank angle of the crankshaft 10 in the internal combustion engine 1 and the ignition timing of the fuel with respect to the quantity of the injected fuel in the form of a map accessible for obtaining the quantity of the injected fuel and the ignition timing in step S1009. Subsequent to step S1009, the process then proceeds to step S1010.

In step S1010, an engine starting torque required for starting the internal combustion engine 1 is obtained. More specifically, the engine starting torque is obtained based on the cooling water temperature of the internal combustion engine 1. The calculation of the engine starting torque will be described referring to FIG. 13.

Figure 13:
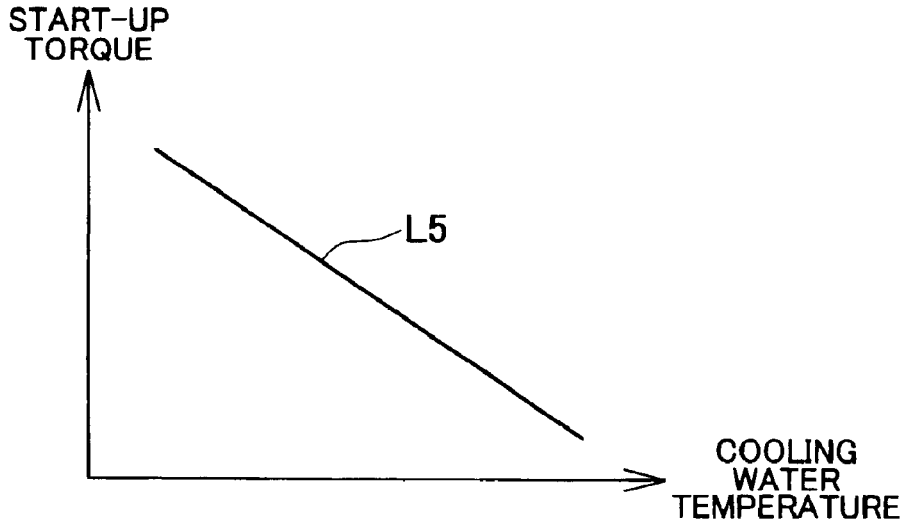
FIG. 13 is a graph showing a change in the engine starting torque with respect to the cooling water temperature of the internal combustion engine.

FIG. 13 is a graph that shows the change in the engine starting torque with respect to the cooling water temperature of the internal combustion engine 1. The x-axis of the graph represents the cooling water temperature, and the y-axis of the graph represents the engine starting torque. The line L5 represents the change in the engine starting torque. Referring to FIG. 13, as the cooling water temperature increases, the engine starting torque decreases owing to reduction in the viscosity of the lubricating oil applied to the sliding elements of the internal combustion engine 1. The ROM of the ECU 12 stores the data including the engine starting torque with respect to the cooling water temperature of the internal combustion engine 1 in the form of an accessible map so as to be used for executing step S1010 where the engine starting torque is obtained. Subsequent to execution in step S1010, the process proceeds to step S1011.

In step S1011, the combustion torque is obtained based on the combustion condition obtained in step S1009, that is, the quantity of the injected fuel and the ignition timing. The combustion torque varies as the fuel combustion proceeds to take a peak value at a certain point. Subsequent to execution in step S1011, the process proceeds to step S1012.

In step S1012, the timing for assisting the internal combustion engine 1 in starting the internal combustion engine 1 (hereinafter referred to as an assist timing) by controlling the motor generator 100 in the normal direction to generate the torque to the crankshaft 10. The determination of the assist timing will be described.

Figure 14:
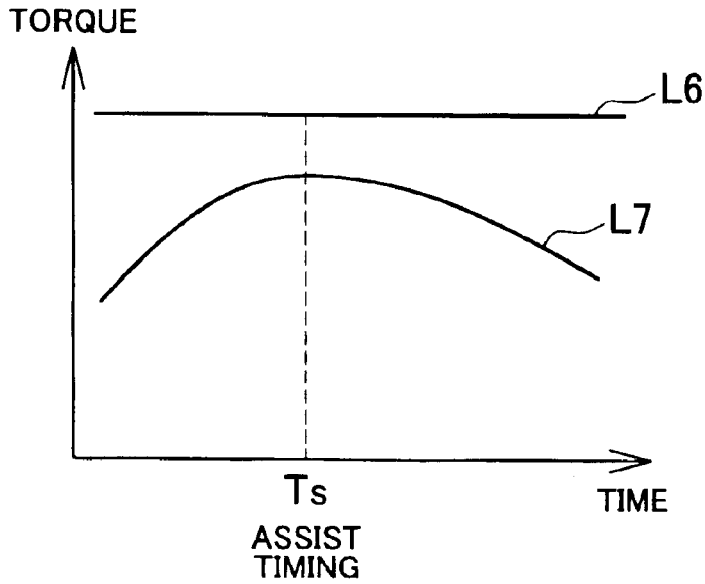
FIG. 14 is a graph showing a change in the engine starting torque and the combustion torque with respect to a time passage.

FIG. 14 is a graph showing each change in the engine starting torque and the combustion torque as the combustion of the fuel in the cylinder identified to be in the expansion stroke proceeds. The x-axis of the graph represents the time passage of combustion, and the y-axis represents the value of the torque. The line L6 shows the engine starting torque, and the curve L7 shows the combustion torque.

As the graph shows, the engine starting torque takes a constant value irrespective of time passage. Meanwhile, the combustion torque takes a peak value at a time point Ts. The difference between the engine starting torque and the combustion torque becomes the smallest at the time point Ts. If the assist timing of the motor generator 100 is adjusted to be close to the time point Ts, the output of the motor generator 100 required for starting the internal combustion engine 1 may be minimized. Subsequent to execution in step S1012, the process proceeds to step S1013.

In step S1013, the motor generator 100 is rotated in the reverse direction so as to rotate the crankshaft 10 in the reverse direction. The fuel by the quantity obtained in step S1009 is injected from the fuel injection valve 6. The motor generator 100 is rotated in the reverse direction in step S1013 until the crank angle of the crankshaft 10 reaches the predetermined angle likewise the process from step S406 to S407 of the flowchart shown in FIG. 4. As a result, the residual gas in the cylinder is compressed to increase the temperature thereof to become high enough to make the fuel combustible. When the crank angle of the crankshaft 10 has reached the predetermined angle, the process proceeds to step S1014.

In step S1014, the ignition is performed by the spark plug 5 at the ignition timing obtained in step S1009. The motor generator 100 functions in assisting for starting the internal combustion engine 1 at the assist timing obtained in step S1012. Subsequent to execution in step S1014, the process proceeds to step S1015.

In step S1015, it is determined whether starting of the internal combustion engine 1 has been completed. If Yes is obtained in step S1015, that is, it is determined starting of the internal combustion engine 1 has been completed, the control routine ends. If No is obtained in step S1015, that is, it is determined that the internal combustion engine 1 has not been started in spite of the assistance of the motor generator 100 and combustion of the fuel in step S1014, the process proceeds to step S1016.

In step S1016, the motor generator 100 is driven to start the internal combustion engine 1 by performing normal cranking operation. In this case, the assistance by supplying the combustion torque is not provided for starting the internal combustion engine 1. So the output torque generated by the motor generator 100 is increased in step S1016 compared with the output torque generated by the motor generator 100 in step S1014. The internal combustion engine 1, thus, is started. Subsequent to execution in step S1016, the control routine ends.

In the starting system for the internal combustion engine by rotating the output shaft in the reverse direction once, and then in the normal direction for starting cranking operation, the fuel is combusted in the cylinder in the expansion stroke when the output shaft is rotated in the reverse direction. The combustion torque generated by the combustion pressure is used for the cranking operation so as to avoid the increase in the rating of the motor generator 100. The crank angle of the crankshaft 10 is changed to the angle at which the quantity of air in the cylinder is increased before rotating the motor generator 100 in the reverse direction. This makes it possible to increase the combustion torque in the cylinder. This makes it possible to prevent the rating of the motor generator 100 from being increased.

According to the embodiment, if the internal combustion engine 1 is not started well in spite of the fuel combustion torque and the assist torque generated by the motor generator 100, it is started by the normal cranking operation of the motor generator 100 by itself. In this case, the motor generator 100 is required to generate a large assist torque on the temporary basis. However, the rating of the motor generator 100 may be prevented from being increased so long as the frequency of performing the normal cranking operation is relatively low.

The starting control system for an internal combustion engine is structured to rotate the output shaft in the reverse direction for starting the engine once, and then in the normal direction. In this system, the fuel is combusted in the cylinder in the expansion stroke when the output shaft is rotated in the reverse direction, and the resultant gas compressive force and the combustion pressure may be used for the cranking operation. This makes it possible to reduce the torque required for the motor generator to perform the cranking operation. The torque or the motor generator required for the cranking operation may be reduced. Accordingly the internal combustion engine can be started without increasing the rating and power consumption of the motor generator.

What is claimed is:

1. A starting control system for an internal combustion engine comprising:

an electric motor that drives an output shaft of the internal combustion engine so as to be rotated; and a controller that controls the electric motor to rotate the output shaft in a first direction subsequent to a rotation of the output shaft in a second direction at a predetermined angle upon start of the internal combustion engine, the second direction being reverse to the first direction, and combusts a fuel in a cylinder in an expansion stroke when the electric motor is rotated in the second direction.

2. The starting control system for an internal combustion engine according to claim 1, wherein an intake valve and an exhaust valve of a cylinder in an intake stroke when the electric motor is rotated in the second direction are closed such that the fuel is combusted in the cylinder in the intake stroke.

3. The starting control system for an internal combustion engine according to claim 1, wherein a crank stop position of the output shaft is changed to a predetermined position so as to increase quantity of air in the cylinder in the expansion stroke while the electric motor being rotating in the second direction within a period from a timing after the internal combustion engine is stopped to a timing when the electric motor starts rotating in the second direction.

4. The starting control system for an internal combustion engine according to claim 3, wherein a fuel combustion condition for combusting the fuel in the cylinder in the expansion stroke while the electric motor being rotating in the second direction is obtained based on at least one of the crank stop position of the output shaft that has been changed and a temperature of the internal combustion engine.

5. The starting control system for an internal combustion engine according to claim 4, wherein the fuel combustion condition is obtained based on at least one of quantity of air in the cylinder in the expansion stroke and a temperature of the cylinder obtained from a temperature of a cooling water in the internal combustion engine.

6. The starting control system for an internal combustion engine according to claim 4, wherein the fuel combustion condition comprises a fuel injection quantity and an ignition timing.

7. The starting control system for an internal combustion engine according to claim 1, wherein the controller:

obtains an engine starting torque required for starting the internal combustion engine, and a combustion torque generated in the cylinder in the expansion stroke while the electric motor being rotating in the second direction such that the fuel is combusted therein; and determines an assist timing at which the electric motor outputs an assist torque to the output shaft based on at least the engine starting torque and the combustion torque such that the assist torque upon rotation of the electric motor in the first direction becomes minimum.

8. The starting control system for an internal combustion engine according to claim 3, wherein when the crank stop position of the output shaft fails to reach an exhaust valve opening position at which the exhaust valve of the cylinder in the expansion stroke while the electric motor being rotating in the second direction starts opening, the crank stop position is changed to a position just before the exhaust valve opening position.

9. The starting control system for an internal combustion engine according to claim 8, wherein a fuel combustion condition for combusting the fuel in the cylinder in the expansion stroke while the electric motor being rotating in the second direction is obtained based on at least one of the crank stop position of the output shaft that has been changed and a temperature of the internal combustion engine.

10. The starting control system for an internal combustion engine according to claim 9, wherein the fuel combustion condition is obtained based on at least one of quantity of air in the cylinder in the expansion stroke and a temperature of the cylinder obtained from a temperature of a cooling water in the internal combustion engine.

11. The starting control system for an internal combustion engine according to claim 9, wherein the fuel combustion condition comprises a fuel injection quantity and an ignition timing.

12. The starting control system for an internal combustion engine according to claim 9, wherein the controller:

obtains an engine starting torque required for starting the internal combustion engine, and a combustion torque generated in the cylinder in the expansion stroke while the electric motor being rotating in the second direction such that the fuel is combusted therein; and determines an assist timing at which the electric motor outputs an assist torque to the output shaft based on at least the engine starting torque and the combustion torque such that the assist torque upon rotation of the electric motor in the first direction becomes minimum.

13. A starting control method for an internal combustion engine in which an electric motor that drives an output shaft of the internal combustion engine is provided so as to be rotated, the method comprising:

controlling the electric motor to rotate the output shaft in a first direction subsequent to a rotation of the output shaft in a second direction at a predetermined angle upon start of the internal combustion engine, the second direction being reverse to the first direction; and combusting a fuel in a cylinder in an expansion stroke when the electric motor is rotated in the second direction.

14. The starting control method for an internal combustion engine according to claim 13, further comprising closing an intake valve and an exhaust valve of a cylinder in an intake stroke while the electric motor being rotating in the second direction such that the fuel is combusted in the cylinder in the intake stroke.

15. The starting control method for an internal combustion engine according to claim 13, wherein a crank stop position of the output shaft is changed to a predetermined position so as to increase quantity of air in the cylinder in the expansion stroke while the electric motor being rotating in the second direction within a period from a timing after the internal combustion engine is stopped to a timing when the electric motor starts rotating in the second direction.

16. The starting control method for an internal combustion engine according to claim 15, wherein a fuel combustion condition for combusting the fuel in the cylinder in the expansion stroke while the electric motor being rotating in the second direction is obtained based on at least one of the crank stop position of the output shaft that has been changed and a temperature of the internal combustion engine.

17. The starting control method for an internal combustion engine according to claim 13, wherein an engine starting torque required for starting the internal combustion engine is obtained, and a combustion torque generated in the cylinder in the expansion stroke while the electric motor being rotating in the second direction is obtained such that the fuel is combusted therein; and an assist timing at which the electric motor outputs an assist torque to the output shaft is determined based on at least the engine starting torque and the combustion torque such that the assist torque upon rotation of the electric motor in the first direction becomes minimum.

18. The starting control method for an internal combustion engine according to claim 15, wherein when the crank stop position of the output shaft fails to reach an exhaust valve opening position at which the exhaust valve of the cylinder in the expansion stroke while the electric motor being rotating in the second direction starts opening, the crank stop position is changed to a position just before the exhaust valve opening position.

19. The starting control method for an internal combustion engine according to claim 18, wherein a fuel combustion condition for combusting the fuel in the cylinder in the expansion stroke while the electric motor being rotating in the second direction is obtained based on at least one of the crank stop position of the output shaft that has been changed and a temperature of the internal combustion engine.

20. The starting control method for an internal combustion engine according to claim 19, wherein an engine starting torque required for starting the internal combustion engine is obtained, and a combustion torque generated in the cylinder in the expansion stroke while the electric motor being rotating in the second direction is obtained such that the fuel is combusted therein; and an assist timing at which the electric motor outputs an assist torque to the output shaft is determined based on at least the engine starting torque and the combustion torque such that the assist torque upon rotation of the electric motor in the first direction becomes minimum.

* * * * *